US005551647A

United States Patent [19]

Browning

[11] Patent Number: 5,551,647

[45] Date of Patent: Sep. 3, 1996

[54] CABLE STORAGE AND FEEDING DEVICE

[76] Inventor: Thomas D. Browning, 1222 VA Ave., Norton, Va. 24273

[21] Appl. No.: 258,656

[22] Filed: Jun. 10, 1994

Related U.S. Application Data

[63] Continuation-in-part of Ser. No. 553,612, Jul. 18, 1990, abandoned, Ser. No. 650,284, Feb. 4, 1991, abandoned, and Ser. No. 10,490, Jan. 28, 1993, abandoned.

[51] Int. Cl.[6] ..... B65H 75/24

[52] U.S. Cl. ..... 242/578.2; 242/588.2; 242/608; 242/118.5

[58] Field of Search ..... 242/578.2, 580, 242/587, 588, 588.2, 608, 608.3, 118.5, 129.5, 129.6

[56] References Cited

U.S. PATENT DOCUMENTS

| | | | |
|---|---|---|---|
| 462,898 | 11/1991 | Gandy . | |
| 483,830 | 10/1992 | Buchanan . | |
| 649,694 | 5/1900 | Hunter . | |
| 2,188,086 | 1/1940 | Mossberg | 242/118.5 |
| 2,374,111 | 4/1945 | LeTourneau | 242/587 |
| 2,496,402 | 2/1950 | McVeigh et al. | 242/118.5 |
| 2,695,142 | 11/1954 | Fons et al. . | |
| 2,795,385 | 6/1957 | Becker . | |
| 2,905,408 | 9/1959 | Frate et al. | 242/118.5 |
| 3,134,558 | 5/1964 | McDuffie | 242/137 |
| 3,837,597 | 9/1974 | Bourhenne | 242/129 |
| 3,840,713 | 10/1974 | Carpentier . | |
| 3,876,045 | 4/1975 | Knarreborg . | |
| 3,879,659 | 4/1975 | Lawson, Jr. . | |
| 3,880,378 | 4/1975 | Ballenger . | |
| 4,015,795 | 4/1977 | Chong . | |
| 4,072,278 | 2/1978 | Peterson . | |
| 4,721,833 | 1/1988 | Dubay . | |
| 4,913,369 | 4/1990 | Lia et al. | 242/129 |
| 4,993,449 | 2/1991 | Strutzman . | |
| 5,060,882 | 10/1991 | Rousculp et al. | 242/129.6 |

FOREIGN PATENT DOCUMENTS

| | | | |
|---|---|---|---|
| 922296 | 3/1973 | Canada . | |
| 2714339 | 10/1978 | Germany | 242/118.5 |
| 330079 | 5/1958 | Switzerland . | |
| 292322 | 6/1928 | United Kingdom | 242/118.5 |

*Primary Examiner*—John P. Darling

[57] ABSTRACT

A portable, cable feeding or dispensing device having a base adapted to to be placed on and rest firmly on a floor, the ground or other support, stanchions affixed to the base and extending generally normally therefrom, shoulders on the stanchions formed by notches in an edge of each, a spool assembly having a hub, opposed first and second rims thereon, and an axle therethrough, the first rim being stationarily affixed on the spindle, the second rim or rims having a bearing for slidably mounting the same on the hub, a lock mechanism on the second rim or rims and hub for removably locking the same to the hub at a desired position therealong with respect to the first rim for confining therebetween coiled cable or cables mounted on the hub, the notches adapted to receive end portions of the axle lying outboard of the rims and support the spool for rotational motion for uncoiling and dispensing the cable.

17 Claims, 5 Drawing Sheets

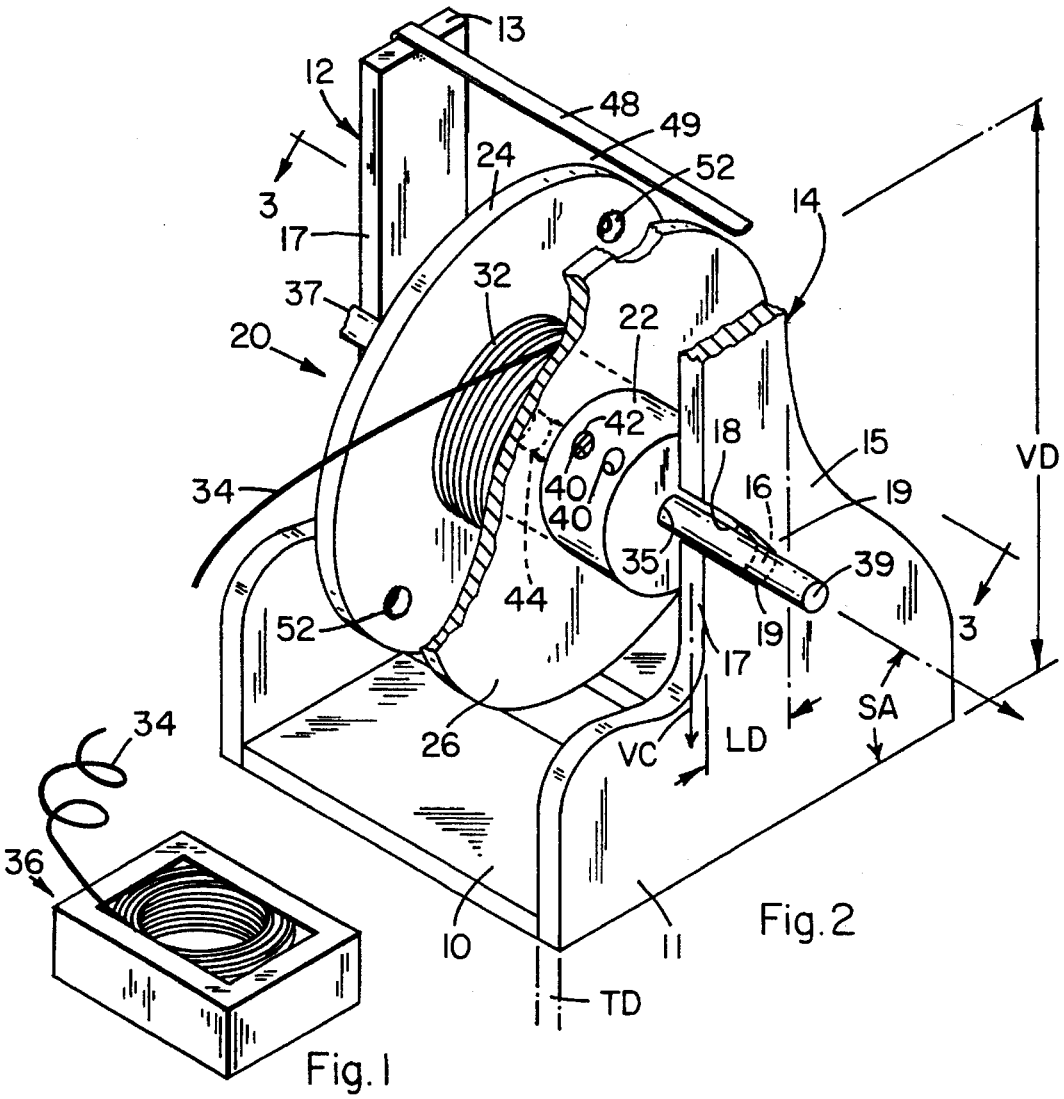
Fig. 1
Fig. 2
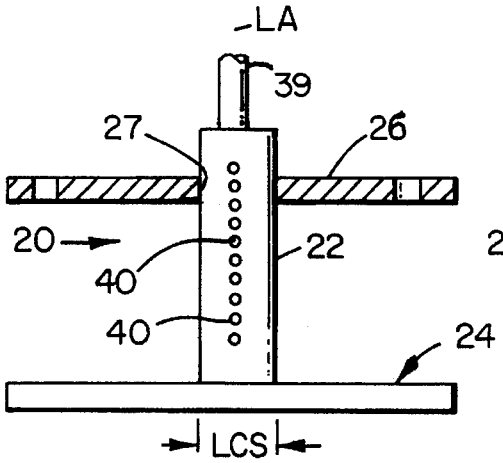
Fig. 3
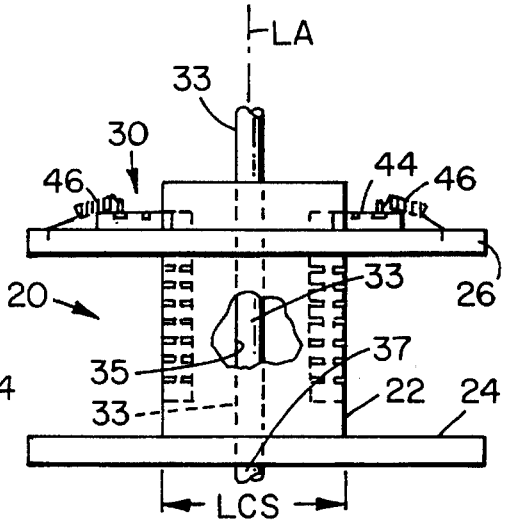
Fig. 4

CABLE STORAGE AND FEEDING DEVICE

FIELD OF INVENTION

This application is a continuation-in-part of applicant's Ser. No. 07/553,612, filed Jul. 18, 1990, now abandoned, a continuation-in-part of Ser. No. 07/650,284, filed Feb. 4, 1991, now abandoned, and a continuation-in-part of Ser. No. 08/010,490, filed Jan. 28, 1993, now abandoned, and concerns feeding means for coiled type cable items, i.e., items such as electrical wire and cable, heavy twine, metal cable, rope, metal wire and the like, and particularly concerns such a device which is capable of handling a variety of such items of different compositions, flexibilities, and cable and coil sizes.

DISCUSSION OF PRIOR ART

Heretofore, the most widely used and convenient device for dispensing electrical wire or cable has been the open top, cardboard box or carton from which the cable is pulled upwardly, as shown in FIG. 1 of the drawing. This type of device is unsatisfactory for several reasons hereinafter given, not the least of which is that the wire comes out of the carton twisted. Other types of cable or wire reeling or dispensing devices are shown in U.S. Pat. Nos. 483,830; 2,695,142; 2,905,408; 3,837,597; and 4,721,833. The structural and/or operational complexities of these devices are readily apparent to one skilled in the art, as is their inapplicability to the workplace for which Applicant's invention is especially adapted.

Objects therefore, of the present invention, are: to provide a low cost, easy to use, storage and feeding device which can readily accommodate cable coils of a wide variety of sizes, materials, and flexibilities, and to provide such a device which can be loaded or unloaded with such coil in an exceptionally rapid manner; and to provide such device having concurrent, multiple coil capacity.

SUMMARY OF THE INVENTION

These and other objects hereinafter appearing have been attained in accordance with the present invention which is defined as a portable feeding or dispensing device for coiled cable items, comprising base means adapted to be placed on and rest firmly on floor means, stanchion means affixed to said base means and extending generally normally therefrom, spool means having hub means and at least one pair of opposed first and second rim means, axle means rotably, slidably mounted through bore means provided, preferably, substantially axially through said spool means, shoulder means on said stanchion means adapted to support said axle means, said first rim means being stationarily affixed on said hub means, said second rim means having bearing means for slidably mounting the same on said hub means, cooperating lock means on said second rim means and hub means for removably locking said second rim means to said hub means at a desired position therealong with respect to said first rim means for confining therebetween a coiled cable item axially mounted on said hub means, said shoulder means adapted to receive at least one portion of said axle means extending axially outwardlly of at least one of said rim means and support said spool means for rotational motion during uncoiling and dispensing of said cable.

In certain preferred embodiments:

(a) said stanchion means comprises a pair of upright wall means spaced apart on said base means to provide cradle means for opposite end portions of said axle means;

(b) each said rim means comprises a plate substantially axially mounted on said hub means;

(c) said spool means has two pairs of first and second rim means;

(d) said lock means comprises cooperating, disengageable stop means on said second rim means and hub means; and (e) said stop means comprises cooperating pin and socket means.

The invention and additional objectives thereof will be further understood from the following description and drawings, not to scale, of preferred embodiments of the invention, wherein:

FIG. 1 is perspective view a typical carton of coiled electrical cable from which the cable is drawn by the electrician;

FIG. 2 is a perspective view of a preferred embodiment of the present device in use, with portions partly broken away or dotted lined for clarity;

FIG. 3 is an elevational view, partly in section, of the spool of FIG. 2 taken along line FIG. 2 in the direction of the arrows and showing a rectangular variation of the round cross-section of the spool hub of FIG. 2;

FIG. 4 is a view of the spool of FIG. 3 rotated 90 degrees in the plane of the drawing;

Figure 5:
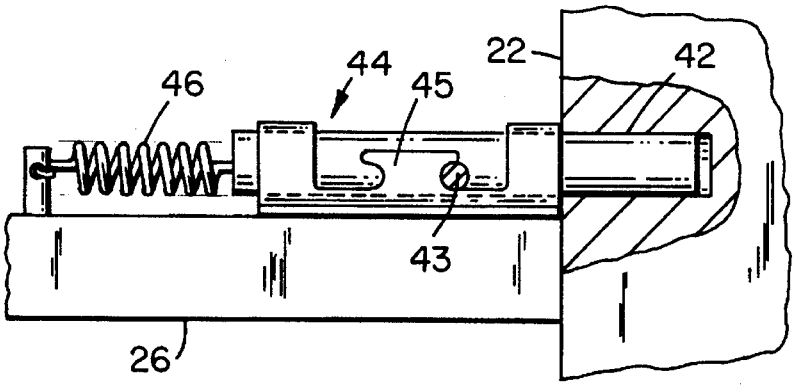
FIG. 5 is an enlarged view of the latch means of FIG. 4.

Referring to the drawings and with reference to the claims hereof, the present device comprises base means 10 of wood, metal, polypropylene, celluose ester, or the like, adapted to be placed on and rest firmly on floor means such as the floor of a house, the ground or any supporting structure, stanchion means 12 and 14 affixed to the base means by screws, welding, glue, or other means, and extending generally normally therefrom, shoulder means 16 on the stanchion means preferably formed by notch means 18 therein and providing cradle means, spool means generally designated 20 having hub means 22 and opposed first and second rim means, 24 and 26 respectively, the first rim means being stationarily affixed on the hub means, the second rim means having bearing means 28 for slidably mounting the same on the hub means, cooperating lock means generally designated 30 on the second rim means and hub means for removably locking the second rim means to the hub means at a desired position therealong with respect to the first rim means for confining therebetween a coiled cable 32 mounted axially on the hub means, axle means 33 rotatably, slidably mounted through bore means 35 provided substantially axially through the spool means, the notch or cradle means adapted to receive opposite end portions 37 and 39 of the axle means lying axially outboard of the rim means and support the spool means for rotational motion during uncoiling and dispensing of the cable.

The present cable feeding device is designed primarily for use in the electrical field and is especially useful for dispensing sheathed electrical cable of types NM, NMC, UF, and the like, commonly sold under the trade made ROMEX. This type of wiring cable 34 is commonly used in building construction where approved by the National Electrical Code and is usually sold in a coiled length of 250 feet, packaged in a cardboard box or carton 36. The most common wire gauges used in building construction that are sold in 250 foot lengths are 14 gauge through 10 gauge, all of which have about the same inside coil diameter and thus can readily slide over the common hub means.

In the wiring of a building or other structure, the cardboard box containing the 250 feet of cable is brought to the building, the box laid down flat, and a hole then cut in the top surface thereof. One end of the wire is then pulled out through the hole and is ready to be pulled through drilled holes or conduit in the building or other structure. The wire is normally left in the box so it will not become uncoiled when not in use. The problem with dispensing the wire straight out of the box is that when a length of wire is pulled, the normal tendency of the wire is to roll, twist and kink. To avoid this, a second person is needed to turn the box as the wire is pulled therefrom so the wire will come out straight and uncoiled such that it can pass through the drilled holes or conduit freely and smoothly. The present device permits the electrician to pull cable from the spool means with no rolls, twists or kinks and without the assistance of a helper.

The portable dispenser is designed so that it may easily be moved to any location throughout the building or structure for ready access to the work area. This portability allows the electrician to have the dispenser as close to his work as needed, thus saving time and effort. Also, where the multi-capacity embodiment of the present device is used, considerable additional time is saved in that the electrician does not have to find a roll of cable of the right size and reload the dispenser.

Referring further to the drawing, the hub means 22 preferably is rectangular in cross-section, and is provided with sockets 40 into which pins or bolts such as 42 mounted on rim means 26 are inserted for locking rim 26 in a desired position on the hub means. In this embodiment, the bearing means 28 in or on rim 26 takes the form of a rectangular opening through which the hub means 22 can slide. The hub and bearing means may, however, have any cross-sectional configuration, including round, oblong, square, or the like.

In using the present cable feeding or dispensing device, the spool assembly consisting of hub means, rim means and axle means is removed from the stanchion or cradle means and laid down in an axial direction with the removable rim disc 26 facing up as shown in FIGS. 3 and 4. As this assembly is laid down, the axle means 33 will slide up through the bore means 35 such that its removal from the assembly is not required. Rim 26 is then removed from the hub by disengaging the two spring held latches 44 and pulling the rim upwardly. The coiled cable or wire, removed from the box, is then simply placed over the hub means and down against the first rim means 24. The second rim means is then replaced over the hub means, lightly down onto the wire, and then locked into position on the hub means by inserting the two spring held latch pins 42 of latches 44, which are secured to the second rim means, into the appropriate sockets 40. A tension spring such as 46 is secured at one end to each latch pin and at its other end to the second rim means as shown in FIG. 5 to prevent inopportune disengagement of the locking means by maintaining spring pressure on latch pin handle 43 forcing it against latch housing 45.

The cable loaded spool assembly is then turned in a substantially, horizontal axial position and the axle means slid back through the hub means so that end portions 37 and 39 of the axle extends axially outward from both ends of the spool assembly. The assembly is then placed on the cradle with the axle end portions positioned in the two notches 18 provided in the stanchion means. Handle 48 is provided to allow the electrician to easily pick up the cable dispenser and carry it to any location for starting the wiring job.

As aforesaid, as the wire is pulled off the spool assembly, it will be dispensed without rolls, twists or kinks. The weight of the spool assembly, the friction of the rotating hub on the axle, and the rigidity of the cable itself will aid in preventing over-pulling or over-dispensing of the wire. When the wiring job is complete, the wire can be restrained from unwinding by threading an end 50 thereof through one of the holes 52 in either rim means, as shown in FIG. 8.

Figure 8:
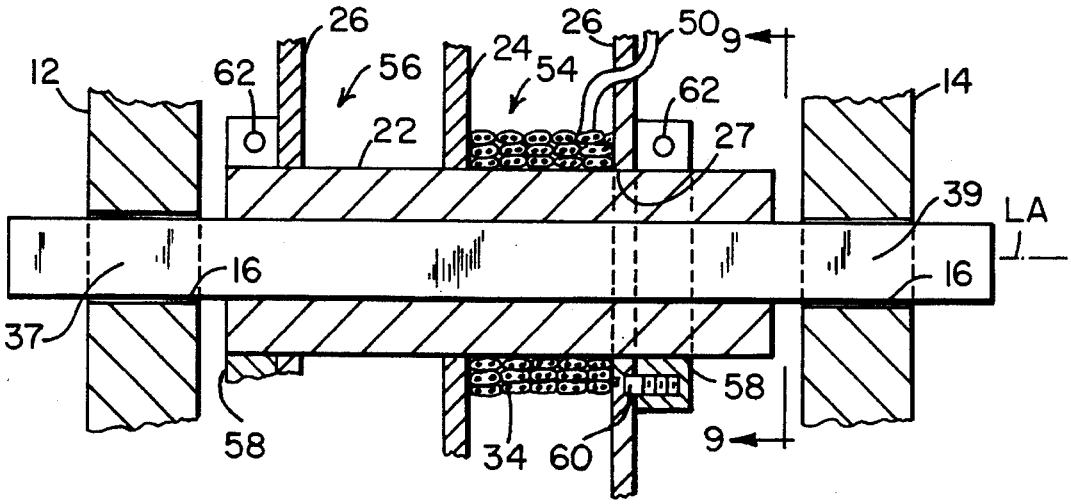
FIG. 8 is a cross-sectional view of a mounted, multi-capacity spool means provided with two adjustable rims and a double sided and double functional first, fixed first rim means and an alternative clamp rim locking or latch means.
Figure 9:
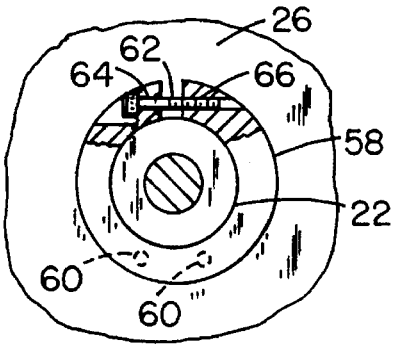
FIG. 9 is a cross-sectional view taken along line 9—9 of FIG. 8 with portions of the locking means broken away for clarity.
Figure 6:
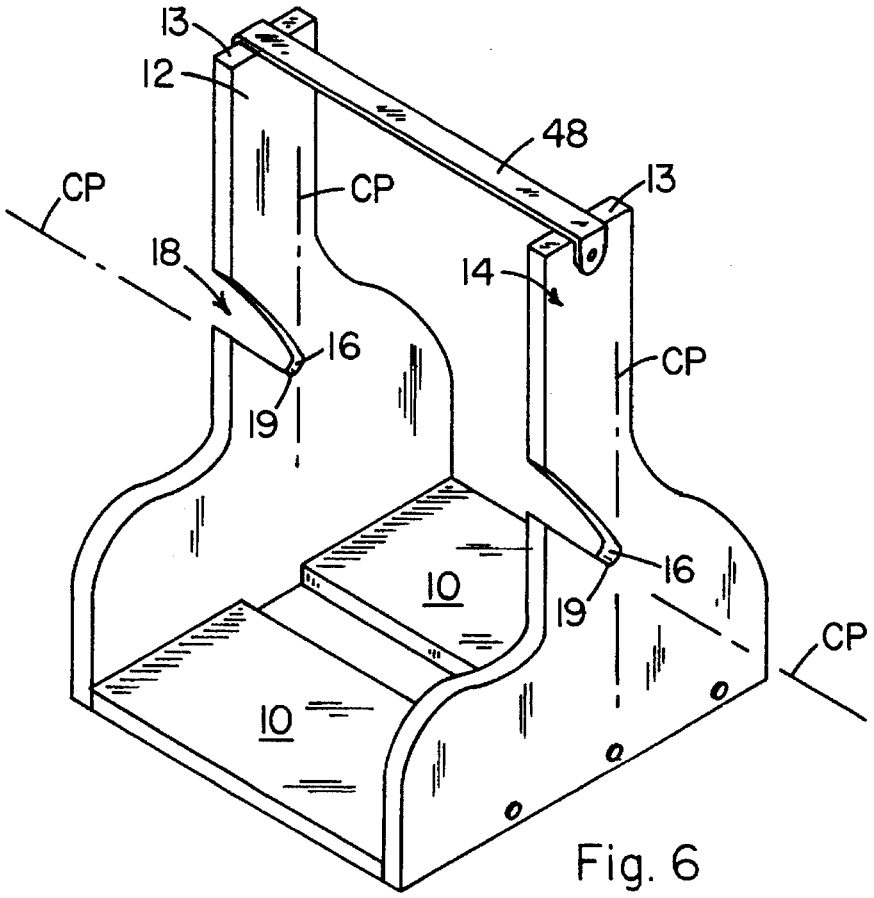
FIG. 6 is an isometric view of the stanchion/base assembly.
Figure 7:
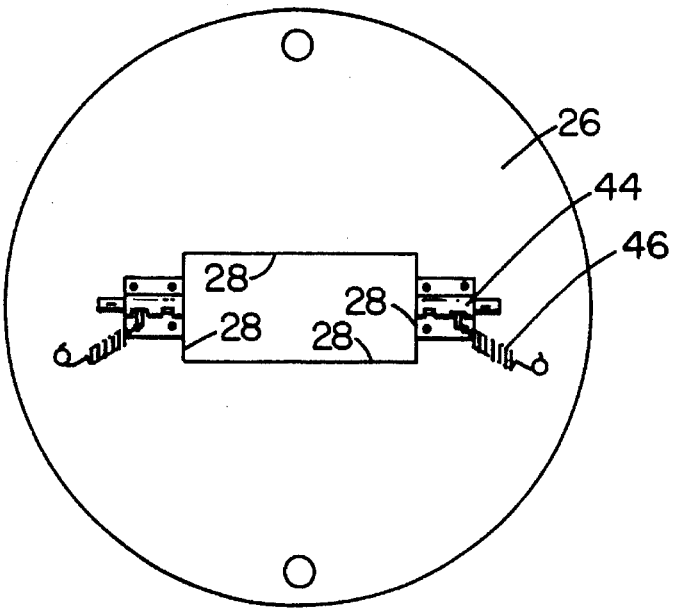
FIG. 7 is an outer side view of the removable, adjustable rim means with the latch means affixed thereto.
Figure 10:
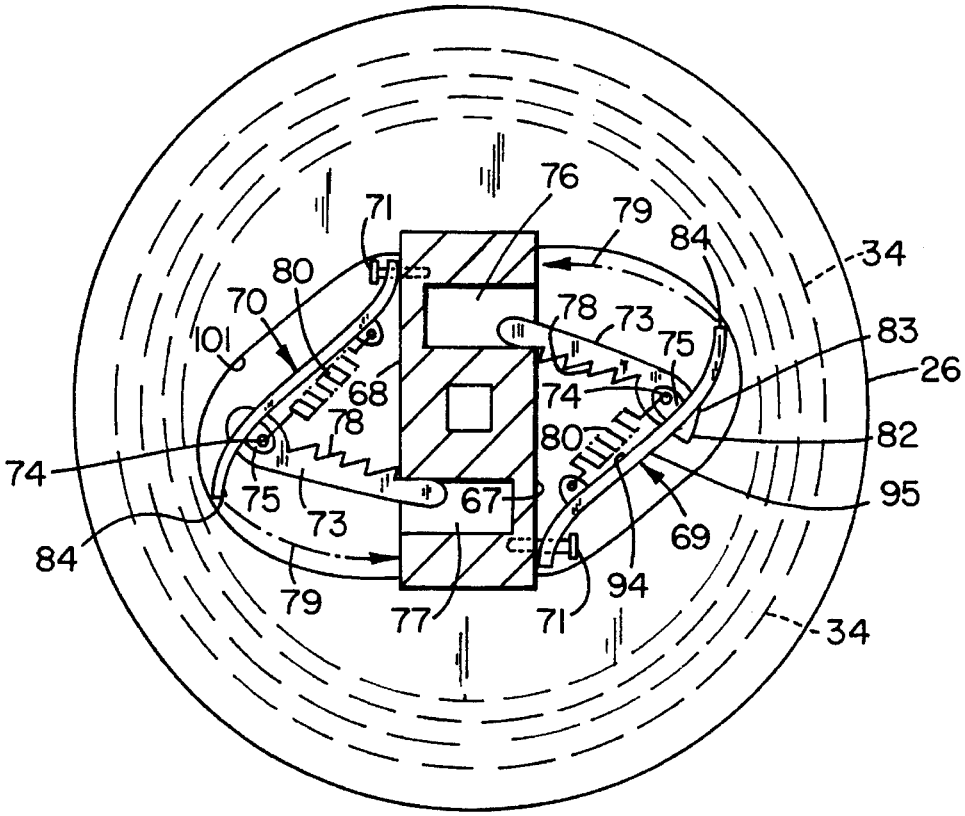
FIG. 10 is a cross-sectional view taken along line 10—10 of FIG. 11 of the adjustable-hub-diameter variation of the present device.

Referring to FIGS. 8 and 9, wherein structure which is the same or equivalent to that of FIGS. 1–7 is numbered the same, this embodiment is the multi-capacity version of the spool means of FIGS. 1–7. It is seen that the first rim means 24 is fixed to the hub means 22 at any desired position thereon, and the two second rim means 26 are located on either side thereof to provide two reeling stations 54 and 56 for the same or different cable types or sizes, e.g., one 14 gauge and the other 12 gauge.

The locking means of FIGS. 8 and 9 may, of course, be the same as in FIGS. 1–7, however, a variation thereof is shown as a split, resilient metal collar 58, secured to the rim means, e.g., by screws 60, and provided with tightening screw 62 slidably passing through bearing 64 and threaded into bore 66, in known manner. Tightening of screw 62 will squeeze the collar tightly onto hub means 22 and firmly hold the rim means in reeling position. It is noted that the split collar and hub may have any of the cross-sectional configurations mentioned above, and many variations of locking means will immediately become apparent to those skilled in the art, such variations are being within the scope of the present invention.

With respect to the claims which include concerning a laterally expandible hub, reference to FIGS. 10–13 will give a better understanding of these claims, as follows:

A portable storage and feeding device for coiled cable items, comprising a base 10 adapted to be placed on a floor, a pair of spaced apart stanchion members 12, 14 each being affixed to said base and extending generally normally upwardly therefrom and formed to have a lower section 11 adjacent said base, an upper section 13 spaced above said base, and an intermediate section 15 lying between said lower and upper sections, said intermediate section of each of said stanchion members having a lateral dimension LD, a vertical dimension VD and a thickness dimension TD, and having a front edge 17 through which a slot or notch means 18 is formed having a lateral component LC and vertical component VC, said lateral component being directed inwardly from said edge and said vertical component being directed downwardly toward said base to give a designed slant angle SA to said slot with respect to the base, preferably of from about 20° to about 60°, the portions generally designated 19 of each of said stanchion members which form and provide the shoulder means or terminus 16 of each said slot lie substantially in a common plane CP passing through both said stanchion members at said terminus, spool means 20 having elongated hub means 22 of substantially uniform lateral cross-section or section LCS which can be round, rectangular, or other geometric shapes and having a longitudinal axis LA, first rim means 24, at least one second rim means 26 having aperture means 27 formed generally axially therethrough, said first and second rim means being mounted in spaced arrangement on said hub means with said hub means 27 being inserted through said aperture means of said second rim means, said first and second rim means axially positioning and retaining cable items 34 in coiled configuration around said hub means, said aperture means being and defined by bearing surface means 28 on said stanchions for longitudinally, axially slidably mounting said second rim means on said hub means, said upper section 13 of each said stanch:ion members being spaced above said base a distance greater than the largest diameter of said first and second rim means, said base and stanchion members providing a supporting structure for said spool means, axle means 33 slidably mounted through bore means 35 provided substantially longitudinally axially through said spool means for rotatably supporting said spool means on said stanchion means, said first rim means being stationarily affixed on said hub means, cooperating latch means 30 on said second rim means and hub means for removably locking said second rim means to said hub means at a desired longitudinal axial position therealong with respect to said first rim means for confining therebetween a coiled cable item 34 axially mounted on said hub means, said shoulder means 16 of said slot contacting said opposite end portions 37, 39 of said axle means which extend axially outwardly of both said rim means and support said spool means on said stanchion means for rotational motion thereof for uncoiling and dispensing said coiled cable item, handle means 48 affixed to said upper section of each of said stanchion members and spanning the same and being positioned above said first and second rim means to provide a clearance space 49 for allowing rotation of said spool means and movement of said second rim means along said hub means, said handle means providing manual lifting means for said device, and wherein said slant angles of said slots are substantially the same and have a sufficient lateral component LC to allow said axle means and said spool means to be operably positioned on said stanchion members or removed therefrom within the limits of said clearance space 49 and without interference with said handle means, said lateral dimension of said intermediate section of each said stanchion member being sufficient to accommodate the slot formed therein while providing sufficient strength to said stanchion members for allowing said device with a loaded spool mounted thereon to be picked up by said handle means.

Referring further to FIGS. 10–13, the side wall portions 67, 68 of hub means 22 are respectively provided with expandable panels 69, 70, each of which is hingedly connected to the wall portion by hinge means such as screws 71 loosely mounted through holes 72 in the panels. Any conventional type of hinge may be used in place of these screws. Each panel is provided with a stop arm or lever means 73 extending through a generously sized aperture 81 in the panel, which arm is pivotally connected by a pivot pin 74 to a tab 75 struck up from the panel. Recesses 76, 77 in opposite sides of the hub receive the arms when the arms are rotated about their pivot pins 74 such as to clear the teeth 78 from the edges of the recesses which allows each panel to be rotated inwardly along line 79. These arms are urged by tension springs 80 in a direction to engage their teeth 78 with the edges of the recesses 76, 77. To disengage these teeth, simple finger pressure on the outer ends or retraction means 82 of the arms in the direction, e.g., of the arrow 83 shown in FIG. 10 will pivot the arm and allow it to be moved inwardly in its recess to diminish the diameter of the hub to accommodate, e.g., smaller diameter cable reels. Simply pulling out of the free ends 84 of the panels will automatically lock them in their expanded positions by the action of springs 80. A suitably sized opening 101 thru second rim means 26 accommodates the panels in all positions thereof.

Further with reference to FIGS. 10–12 and 14, it is preferable that the panel means 69 and 70 are at least about the length L of the adjustment of said second rim means on said hub means as provided by notch means 86 in order to maximize the reel carrying capacity of the device. Also it is preferred that each panel means has a thickness of from about 0.025 in., to about 0.2 in., and is substantially rectangular in shape having inner 94 and outer 95 sides, inner 96 and outer 97 longitudinal edges, and front 98 and rear 99 end edges, said inner longitudinal edge 96 having one element 72 of a pivot means and said hub means having the other element 71 of said pivot means whereby said panel means is pivotally mounted along its inner longitudinal edge on said hub means such that said outer longitudinal edge 97 can swing outwardly or inwardly along an arc 79.

With reference to the operation of the stop arm or lever means 73, the engagement axis, EA, the teeth means 78 make an obtuse angle of contact, OAOC, with the axis of force, AOF, of said lever means, and wherein said obtuse angle of contact is less than the obtuse face angle, OFA, which the face axis, FA, of shoulder means 100 makes with said axis of force, whereby a large force applied along said axis of force will not cause said teeth to slide off of said shoulder means.

Figure 11:
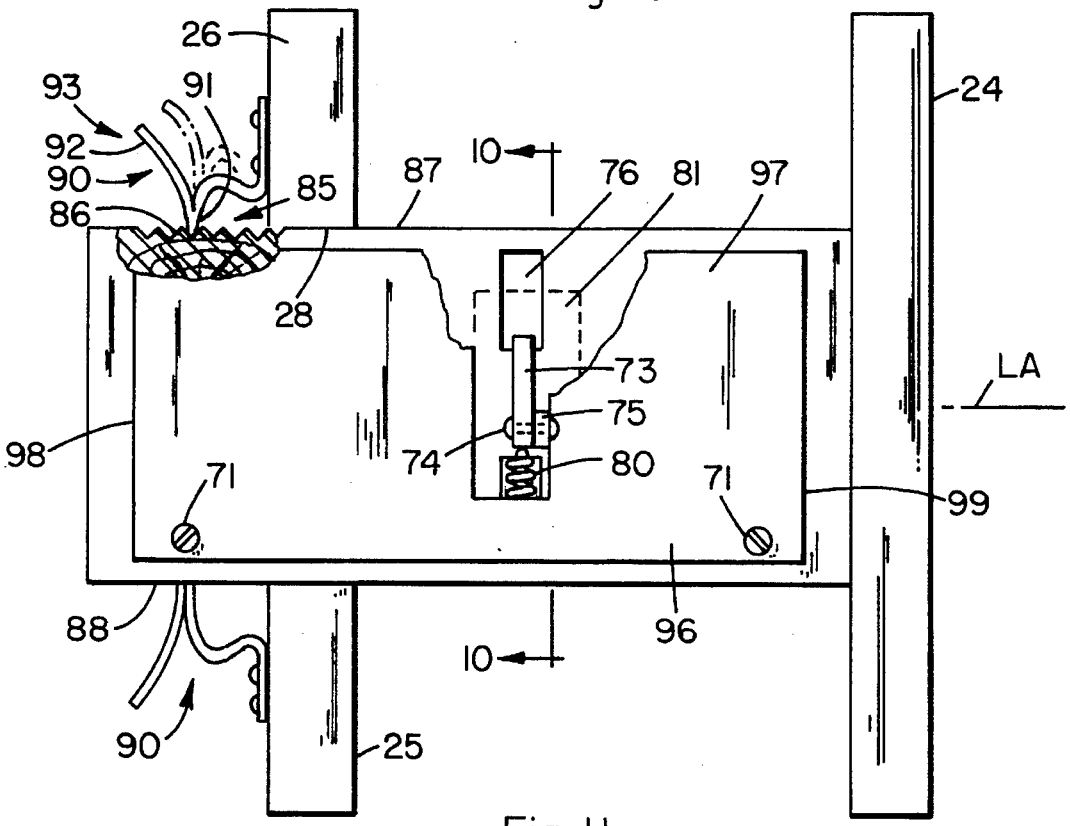
FIG. 11 is a side view of the device of FIG. 10 with portions of a panel broken away for clarity.
Figure 12:
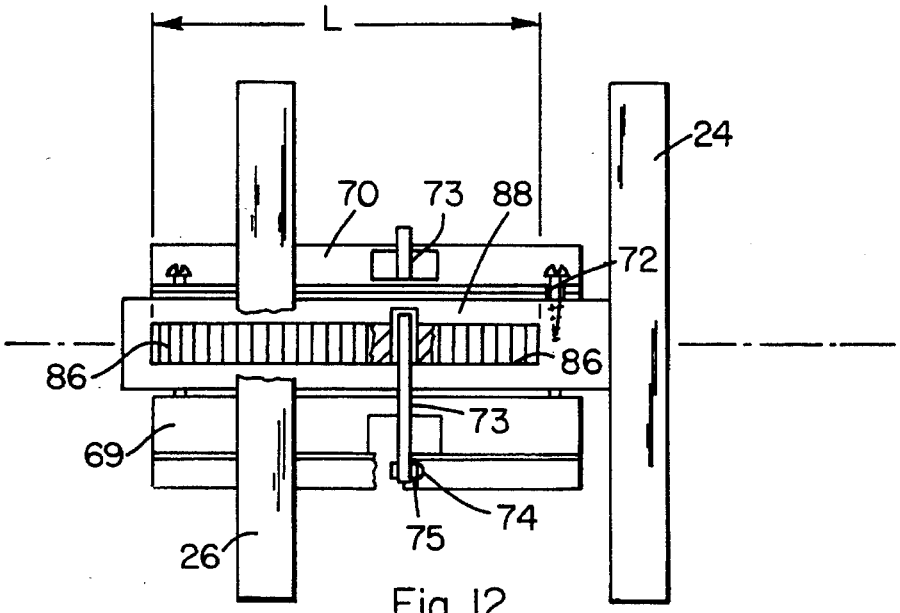
FIG. 12 is a top view of the expandable panel variation of FIGS. 10 and 11.
Figure 13:
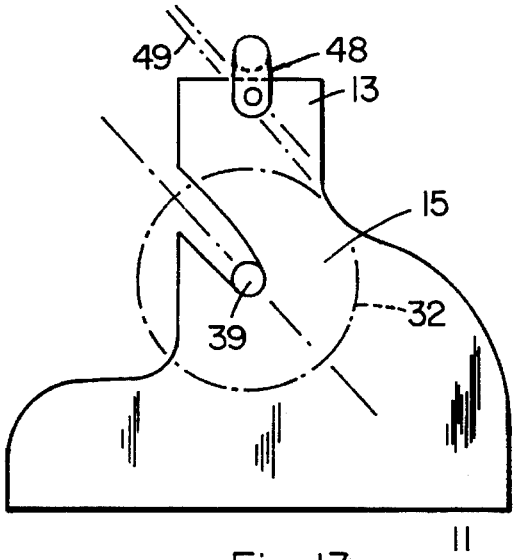
FIG. 13 is an end schematic view of the device of FIG. 1 depicting spatial and clearance parameters.
Figure 14:
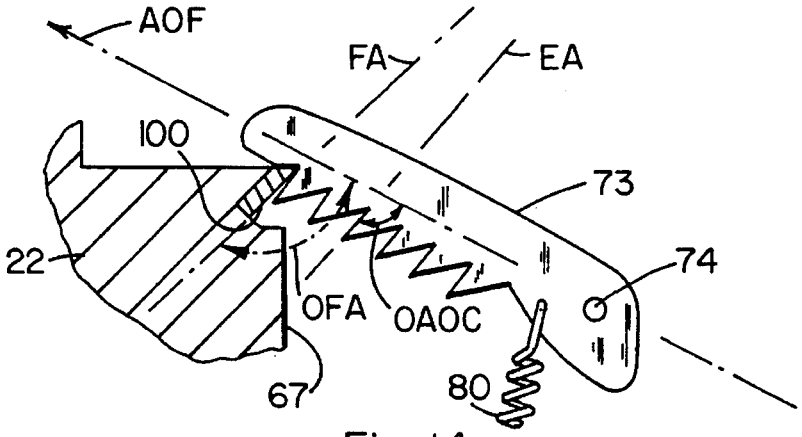
FIG. 14 is an enlarged view of the stop arm mechanism for the expandable panels of FIGS. 10–12.

As shown in FIG. 11, the unique latch means generally designated 85 comprises a plurality of laterally directed notch means 86 in laterally opposite, exterior, longitudinally extending surfaces 87, 88 of said hub means, and lever or leaf spring means 90 on said second rim means having stop shoulder means 91 spring urged into engagement with said notch means for preventing longitudinal movement of said second rim means on said hub means, said lever means further having a compression segment 92 adapted to be contacted with portions of a users hand in the direction of arrow 93 for deflection of said stop shoulder means from said notch means for allowing longitudinal movement of said second rim means along said hub means. The deflected position of said lever means is shown by the dotted line in FIG. 11 wherein the stop shoulder means has been retracted from the notch means. It is particularly noted that the second rim means 26 can be gripped on its inner surface 25 by the fingers while the thumb is pressing inwardly against segment 92 such that with both hands so operating, the positioning adjustment of 26 along the hub is easily and quickly accomplished, e.g., in less than one or two seconds.

This invention has been described in detail with particular reference to preferred embodiments thereof, but it will be understood that variations and modifications will be effected within the spirit and scope of the invention.

I claim:

1. A portable storage and feeding device for coiled cable items, comprising a base adapted to be placed on a floor, a pair of spaced apart stanchion members each being affixed to said base and extending generally normally upwardly therefrom and formed to have a lower section adjacent said base, an upper section spaced above said base, and an intermediate section lying between said lower and upper sections, said intermediate section of each of said stanchion members having a lateral dimension, a vertical dimension and a thickness dimension and having a front edge through which a slot is formed having a lateral component and a vertical component, said lateral component being directed inwardly from said edge and said vertical component being directed downwardly toward said base to give a designed slant angle to each said slot with respect to said base of from about 20° to about 60°, the portions of each of said stanchion members which form and provide said slots further provide a shoulder means at the terminus of each said slot lying substantially in a common plane passing through both said stanchion members at said terminus, spool means for carrying said cable items coiled thereon and having elongated hub means of substantially uniform lateral cross-section and having a longitudinal axis, first rim means, at least one second rim means having aperture means formed generally axially therethrough, said first and second rim means being mounted in spaced arrangement on said hub means with said hub means being inserted through said aperture means of said second rim means, said first and second rim means being adapted to axially position and retain cable items in coiled configuration around said hub means, said aperture means being bordered by bearing surface means for slidably mounting said second rim means on said hub means for providing for longitudinal positioning thereof on said hub means, said upper section of each of said stanchion members being spaced above said base a distance greater than the largest diameter of said first and second rim means, said base and stanchion members providing a supporting structure for said spool means, axle means slidably mounted through bore means provided substantially longitudinally and axially through said spool means for rotatably supporting said spool means, said first rim means being stationarily affixed on said hub means, cooperating latch means on said second rim means and hub means for removably locking said second rim means to said hub means at a desired longitudinal axial position therealong with respect to said first rim means for confining therebetween a coiled cable item axially mounted on said hub means, said shoulder means of said slots contacting opposite end portions of said axle means which extend axially outwardly of both said rim means and support said axle means and said spool means for rotational motion of said spool means for uncoiling and dispensing said coiled cable item, handle means affixed to said upper section of each of said stanchion members and spanning the same and being positioned above said first and second rim means to provide a clearance space, said handle means providing manual lifting means for said device, and wherein said slant angles of said slots are substantially the same and have a sufficient lateral component to allow said axle means and said spool means to be operably positioned on said stanchion members or removed therefrom within the limits of said clearance space and without interference with said handle means, said lateral dimension of said intermediate section of each said stanchion member being sufficient to accommodate the slot formed therein while providing sufficient strength to said stanchion members for allowing said device with a loaded spool mounted thereon to be picked up by said handle means.

2. The device of claim 1 wherein said stanchion members comprise a pair of upright wall means spaced apart on said base to provide cradle means for end portions of said axle means.

3. The device of claim 2 wherein each said rim means comprises a plate substantially axially mounted on said hub means.

4. The device of claim 3 wherein said spool means has two pairs of first and second rim means.

5. The device of claim 4 wherein said latch means comprises split collar means mounted on said second rim means.

6. The device of claim 3 wherein said plates are substantially disc shaped.

7. The device of claim 6 wherein said latch means comprises cooperating pin and socket means on said second rim means and hub means respectively.

8. The device of claim 2 wherein said latch means comprises cooperating, disengageable stop means on said second rim means and hub means.

9. The device of claim 8 wherein said stop means comprises cooperating pin and socket means.

10. The device of claim 1 wherein said latch means comprises split collar means mounted on said second rim means.

11. The device of claim 1 wherein said hub means is constructed to provide side wall portions thereof with at least one radially outwardly expandable panel means whereby said lateral cross-section of said hub means can be adjusted to support coiled cable items having inside coil diameters of varying dimensions.

12. The device of claim 11 wherein said at least one panel means is at least about a length of the adjustment provided for said second rim means along said hub means.

13. The device of claim 11 wherein said at least one panel means has a thickness of from about 0.025 to about 0.2 in., and is substantially rectangular in shape having inner and outer sides, inner and outer longitudinal edges, and front and rear end edges, said inner longitudinal edge having one element of a pivot means and said hub means having the other element of said pivot means whereby said at least one panel means is pivotally mounted along its inner longitudinal edge on said hub means such that said outer longitudinal edge can swing outwardly or inwardly along an arc.

14. The device of claim 13 wherein said at least one panel means is provided with an opening through the sides thereof, lever means pivotally mounted on said at least one panel means with one portion extending outwardly from said at least one outer side of said panel means and another portion extending inwardly from said inner side of said at least one panel means, teeth means provided on said another portion of said lever means, stop means provided on said hub means, said tooth means and stop means being engageable to limit the inward rotation of panel means, spring means connected to said lever means and panel means and continually urging said lever means in an engaging direction to engage said teeth means with said stop, said one portion of said lever means providing a retraction means operable to disengage said teeth means from said stop means by the application of finger pressure to said one portion to pivot said lever means in a disengaging direction away from said stop means, the disengaging of said teeth means from said stop means allowing said panel means to be pivoted inwardly generally in an arc toward said hub means.

15. The device of claim 14 wherein when said teeth means are engaged with said stop means, an engagement axis of said teeth means make an obtuse angle of contact with an axis of force of said lever means, and wherein said obtuse angle of contact is less than the obtuse angle which a face angle of said shoulder means makes with said axis of force, whereby force applied along said axis of force will not cause said teeth to slide off of said stop means.

16. The device of claim 15 wherein said latch means comprises laterally directed notch means in laterally opposite, exterior, longitudinally extending surfaces of said hub means, and leaf means on said second rim means having stop shoulder means spring urged into engagement with said notch means for preventing longitudinal movement of said second rim means on said hub means, and said leaf means being adapted to be contacted with portions of a users hand for retraction of said stop shoulder means from said notch means for allowing longitudinal movement of said second rim means along said hub means.

17. The device of claim 1 wherein said latch means comprises laterally directed notch means in laterally opposite, exterior, longitudinally extending surfaces of said hub means, and leaf means on said second rim means having stop shoulder means spring urged into engagement with said notch means for preventing longitudinal movement of said second rim means on said hub means, and said leaf means being adapted to be contacted with portions of a users hand for retraction of said stop shoulder means from said notch means for allowing longitudinal movement of said second rim means along said hub means.

* * * * *